US010458408B2

(12) United States Patent
Morozumi et al.

(10) Patent No.: US 10,458,408 B2
(45) Date of Patent: Oct. 29, 2019

(54) ROTARY COMPRESSOR HAVING COMMUNICATION PATH HOLE OVERLAP WITH DISCHARGE CHAMBER CONCAVE PORTION

(71) Applicant: FUJITSU GENERAL LIMITED, Kanagawa (JP)

(72) Inventors: Naoya Morozumi, Kanagawa (JP); Taku Morishita, Kanagawa (JP); Motonobu Furukawa, Kanagawa (JP); Hiroki Katayama, Kanagawa (JP); Junya Tanaka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 176 days.

(21) Appl. No.: 15/537,394

(22) PCT Filed: Dec. 11, 2015

(86) PCT No.: PCT/JP2015/084844
§ 371 (c)(1),
(2) Date: Jun. 16, 2017

(87) PCT Pub. No.: WO2016/098710
PCT Pub. Date: Jun. 23, 2016

(65) Prior Publication Data

US 2017/0335848 A1 Nov. 23, 2017

(30) Foreign Application Priority Data

Dec. 19, 2014 (JP) ..... 2014-257818
Oct. 30, 2015 (JP) ..... 2015-215273
Dec. 1, 2015 (JP) ..... 2015-235213

(51) Int. Cl.
*F04C 11/00* (2006.01)
*F04C 18/356* (2006.01)
(Continued)

(52) U.S. Cl.
CPC ..... *F04C 18/356* (2013.01); *F01C 21/108* (2013.01); *F04C 18/3564* (2013.01);
(Continued)

(58) Field of Classification Search
CPC .. F04C 18/356; F04C 18/3564; F04C 23/001; F04C 23/008; F04C 29/0057; F04C 11/001; F01C 21/108; F01C 21/0845
See application file for complete search history.

(56) References Cited

U.S. PATENT DOCUMENTS 7,802,972 B2 9/2010 Shimizu et al.
2011/0027117 A1* 2/2011 Fujino ..... F04C 23/008 418/88
(Continued)

FOREIGN PATENT DOCUMENTS

CN 101160468 A 4/2008
CN 202326242 A 7/2012
(Continued)

OTHER PUBLICATIONS

Chinese Office Action issued in corresponding Chinese Patent Application No. 201580068370.1, dated May 31, 2018, with English Translation.
(Continued)

*Primary Examiner* — Deming Wan
(74) *Attorney, Agent, or Firm* — McDermott Will & Emery LLP

(57) ABSTRACT

In a rotary compressor, a lower end plate cover is formed in a flat plate shape, a lower discharge chamber concave portion is formed in a lower end plate to overlap a lower discharge hole side of a lower discharge valve accommodation concave portion, and the lower discharge chamber concave portion is formed in a fan-like range between a diametrical line passing through a center of a sub-bearing
(Continued)

unit and a midpoint of a line segment connecting a center of the lower discharge hole and a center of a lower rivet to each other and a diametrical line opened by a pitch angle 90° in a direction of the lower discharge hole about the center of the sub-bearing unit. At least a portion of a refrigerant path hole overlaps the lower discharge chamber concave portion and is disposed at a position communicating with the lower discharge chamber concave portion.

8 Claims, 7 Drawing Sheets

(51) Int. Cl.

| | |
|---|---|
| ***F04C 23/00*** | (2006.01) |
| ***F01C 21/08*** | (2006.01) |
| ***F04C 29/12*** | (2006.01) |
| ***F04C 29/00*** | (2006.01) |
| ***F01C 21/10*** | (2006.01) |

(52) U.S. Cl.

CPC ..... *F04C 23/001* (2013.01); *F04C 23/008* (2013.01); *F04C 29/0057* (2013.01); *F04C 29/128* (2013.01); *F04C 29/0085* (2013.01); *F04C 2210/26* (2013.01); *F04C 2240/30* (2013.01); *F04C 2240/40* (2013.01); *F04C 2240/50* (2013.01); *F04C 2240/60* (2013.01); *F04C 2250/102* (2013.01)

(56) References Cited

U.S. PATENT DOCUMENTS

| | | | | |
|---|---|---|---|---|
| 2013/0259725 | A1* | 10/2013 | Yahaba | F04C 18/00 418/55.1 |
| 2014/0250937 | A1* | 9/2014 | Hirayama | F04C 23/008 62/296 |
| 2015/0078928 | A1 | 3/2015 | Wei et al. | |
| 2015/0233376 | A1 | 8/2015 | Ogata et al. | |
| 2017/0335848 | A1 | 11/2017 | Morozumi et al. | |
| 2018/0023567 | A1 | 1/2018 | Tanaka et al. | |

FOREIGN PATENT DOCUMENTS

| | | | | | |
|---|---|---|---|---|---|
| CN | 203081758 | U | | 7/2013 | |
| CN | 103362807 | A | | 10/2013 | |
| CN | 104428536 | A | | 3/2015 | |
| EP | 2873864 | A1 | | 5/2015 | |
| JP | 63-100285 | A | | 5/1988 | |
| JP | H11-132177 | A | | 5/1999 | |
| JP | 2003227485 | A | * | 8/2003 | F04C 18/3564 |
| JP | 2005-351590 | A | | 12/2005 | |
| JP | 2014-009612 | A | | 1/2014 | |
| JP | 2014-145318 | A | | 8/2014 | |
| JP | 2014-231801 | A | | 12/2014 | |
| JP | 2016-118142 | A | | 6/2016 | |
| WO | WO-2013061879 | A1 | * | 5/2013 | F04C 18/356 |
| WO | 2013/094114 | A1 | | 6/2013 | |
| WO | 2013/168193 | A1 | | 11/2013 | |
| WO | WO-2013168194 | A1 | * | 11/2013 | F04C 23/001 |
| WO | 2014/002457 | A1 | | 1/2014 | |
| WO | 2016/098710 | A1 | | 6/2016 | |
| WO | 2016/114016 | A1 | | 7/2016 | |

OTHER PUBLICATIONS

Extended European Search Report issued in corresponding European Patent Application No. 15869915.7, dated Nov. 23, 2018.

Search Report issued in corresponding International Patent Application No. PCT/JP2015/084844, dated Mar. 8, 2016.

Decision to Grant issued in corresponding Japanese Patent Application No. 2014-257818, dated Feb. 9, 2017.

Extended European Search Report issued in EP Patent Applicaiton No. 17201179.3, dated Mar. 19, 2018.

Non-Final Office Action issued in U.S. Appl. No. 15/806,193, dated May 30, 2019.

* cited by examiner

[FIG. 1]
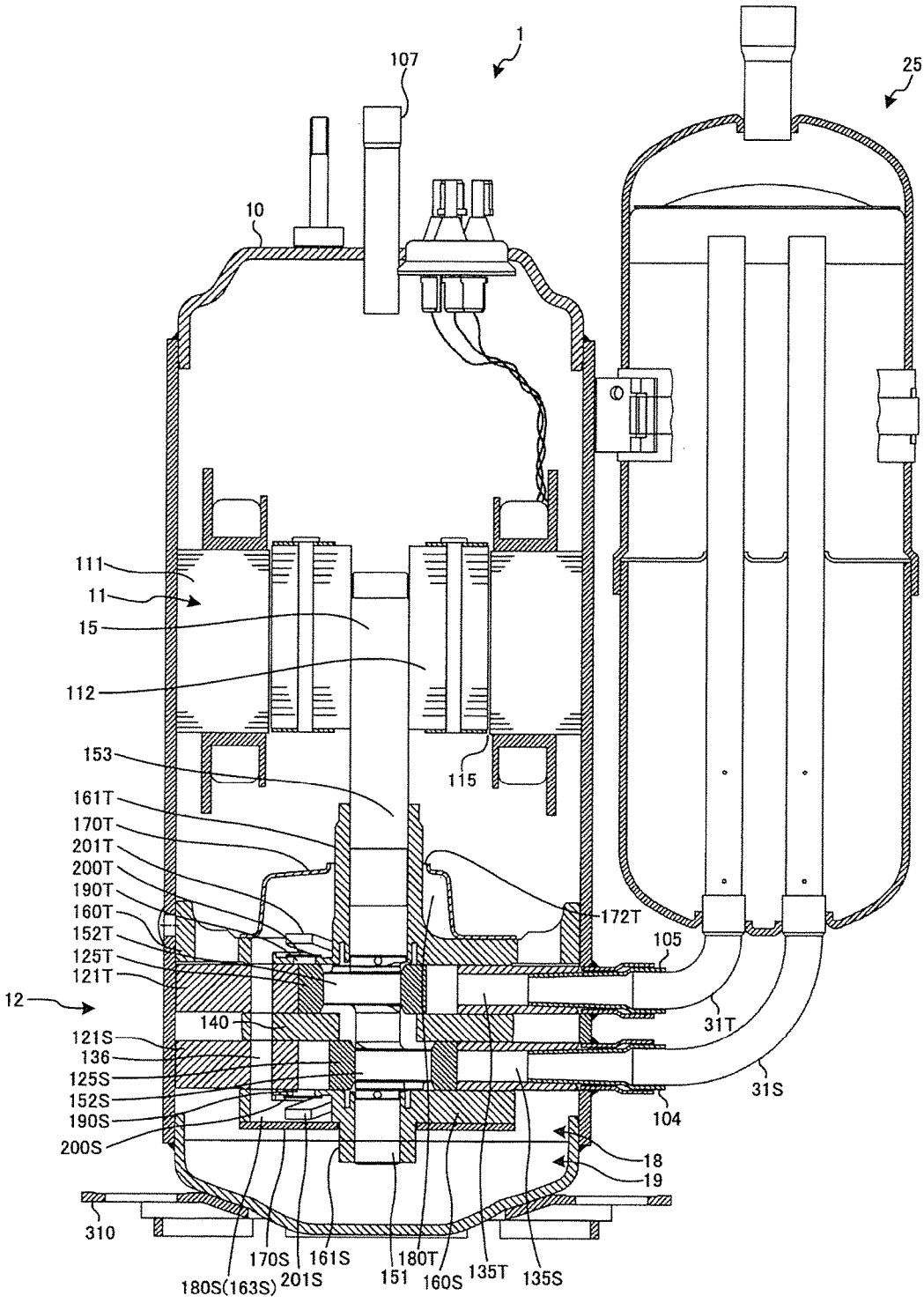

[FIG. 2]
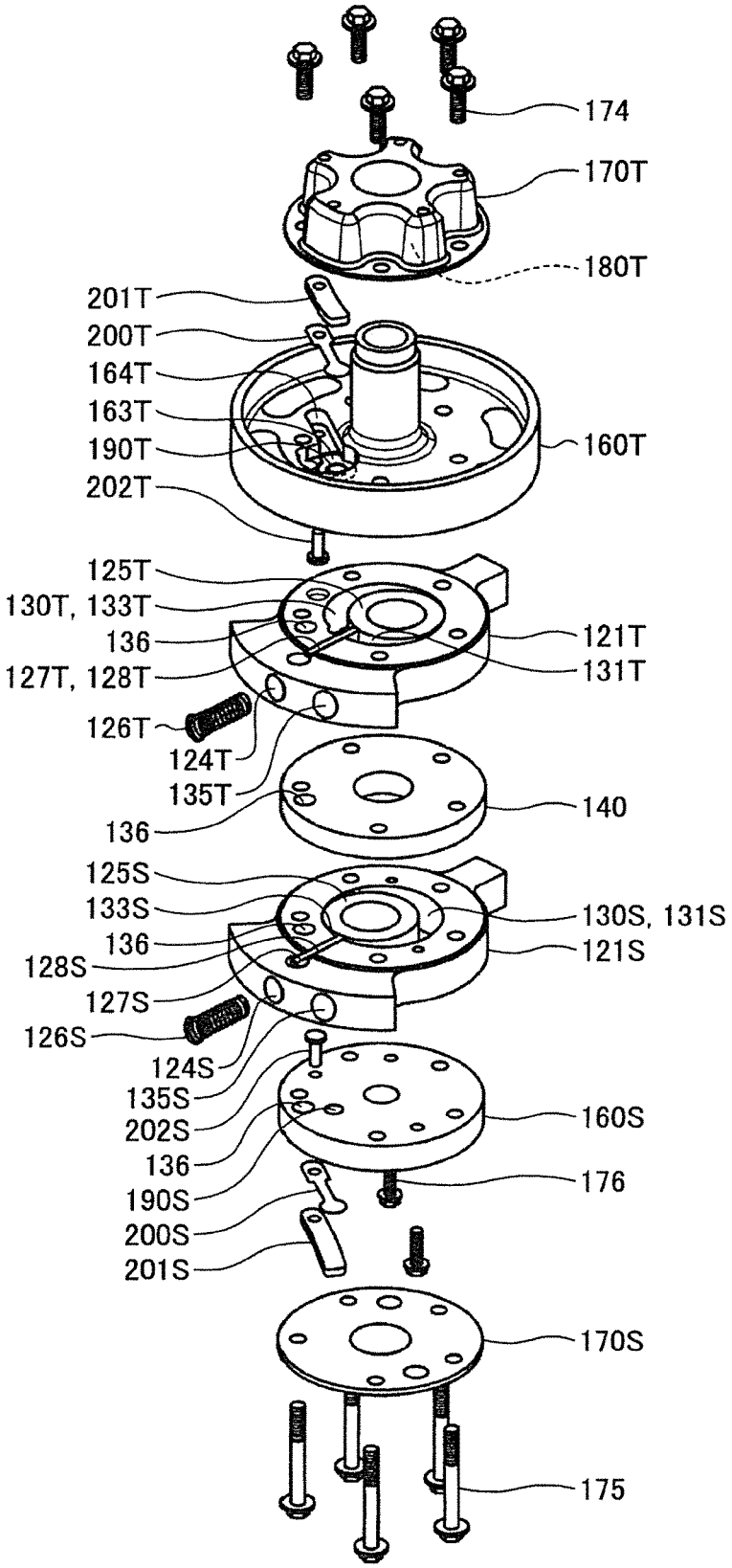

[FIG. 3]
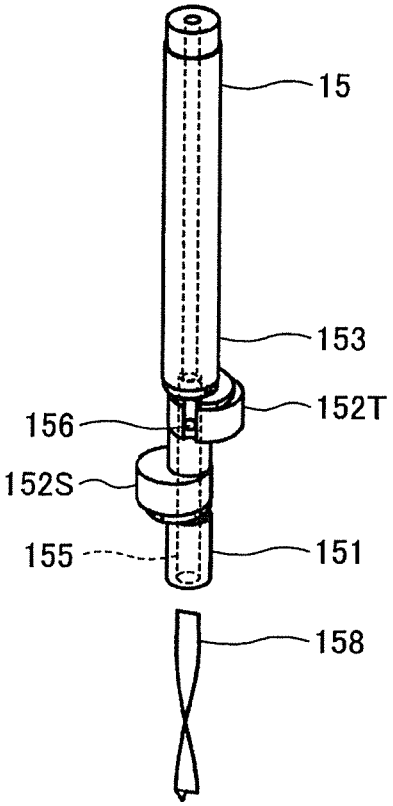

[FIG. 4]
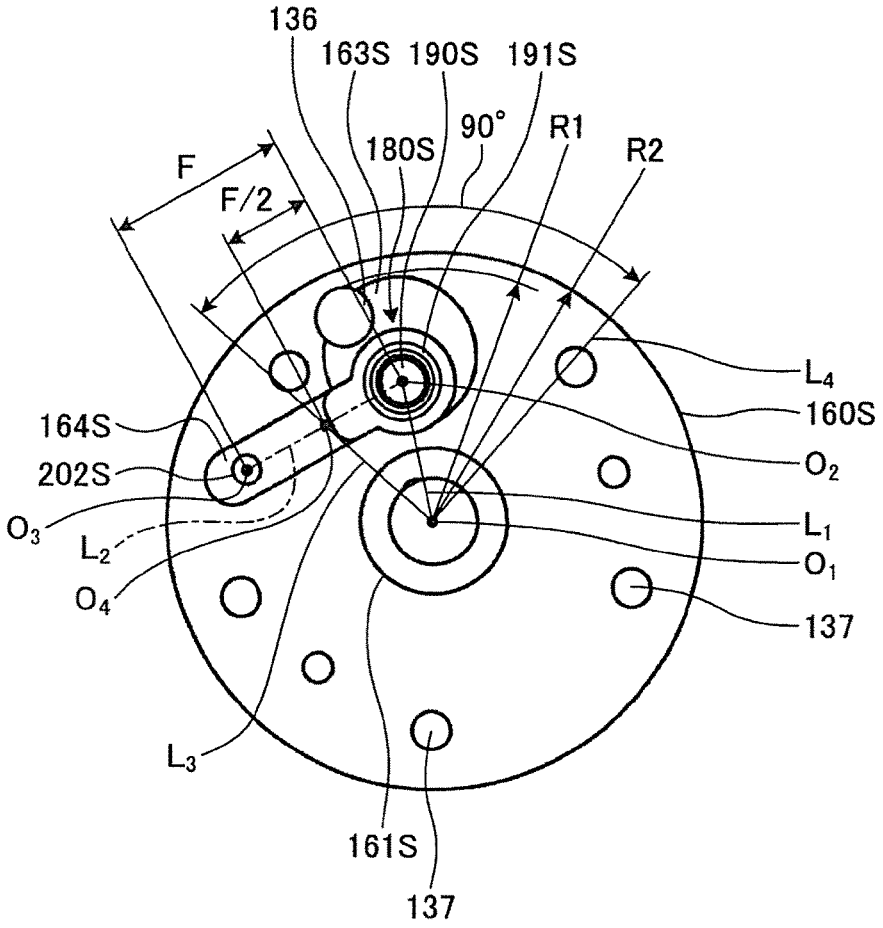
[FIG. 5]
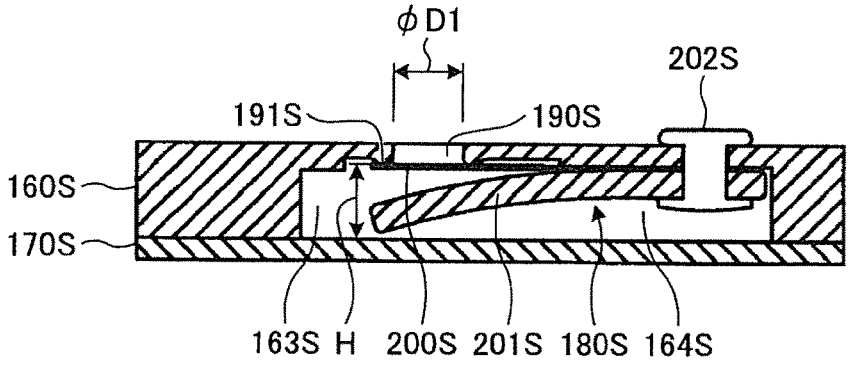

[FIG. 6]
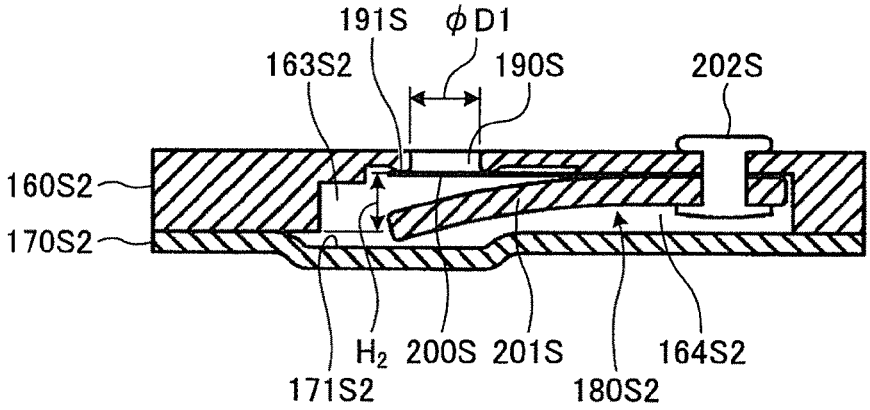
[FIG. 7]
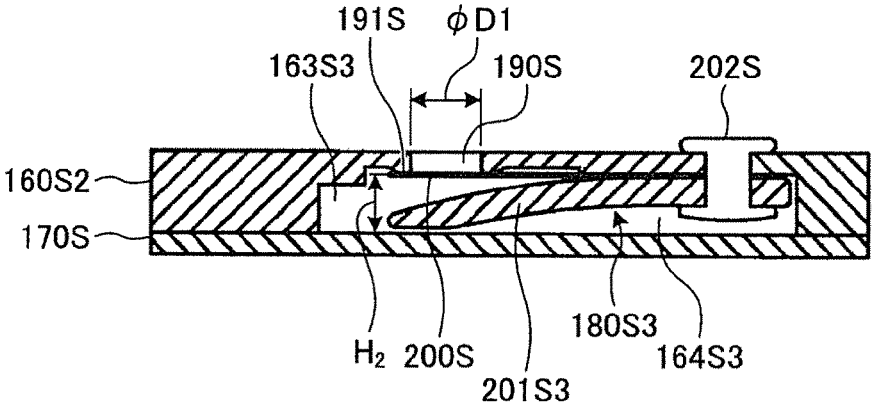

[FIG. 8]
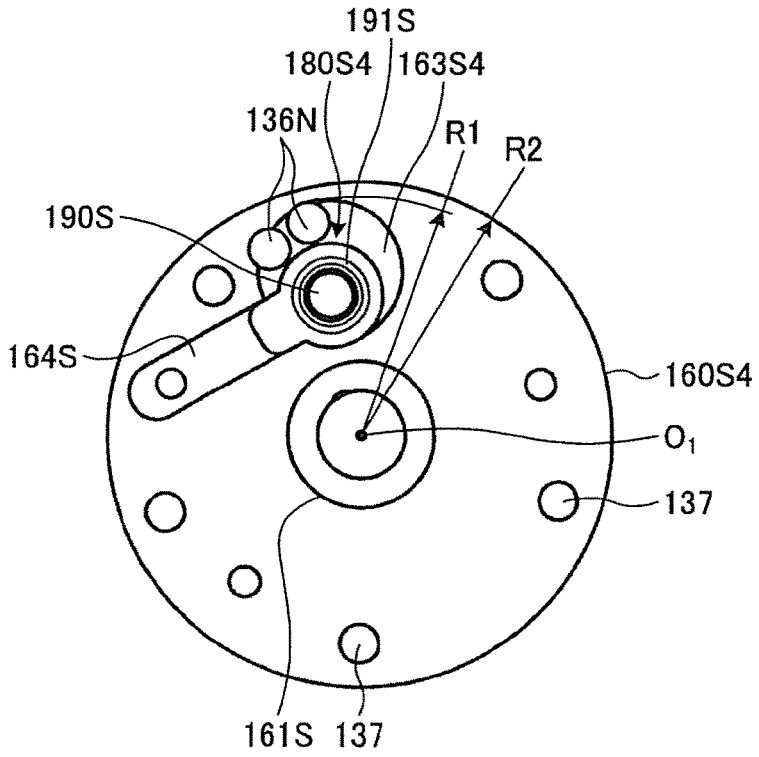
[FIG. 9]
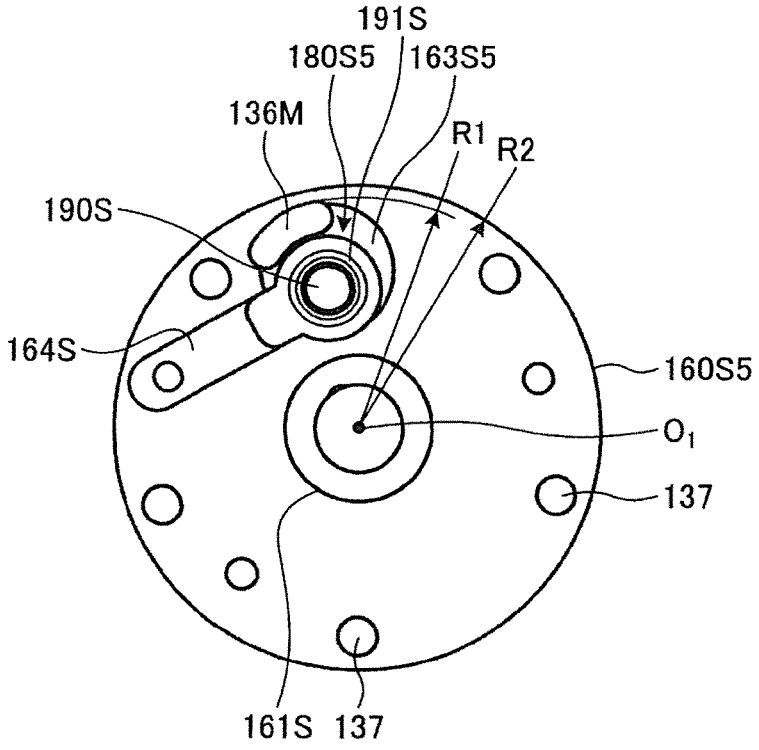

[FIG. 10]
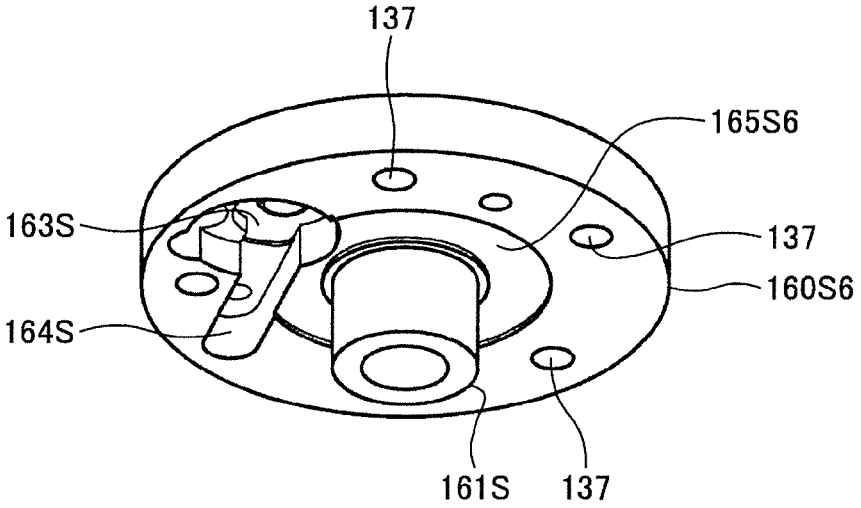
[FIG. 11]
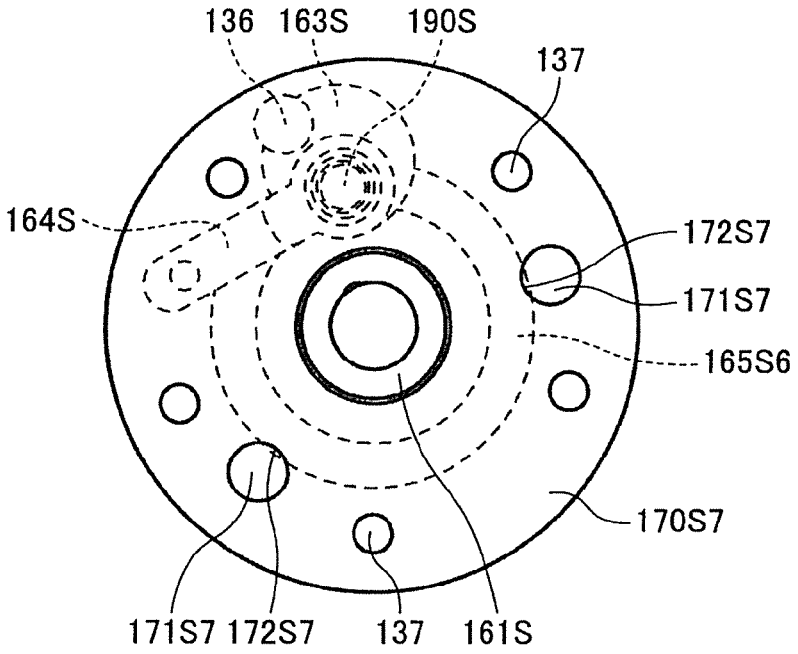

ROTARY COMPRESSOR HAVING COMMUNICATION PATH HOLE OVERLAP WITH DISCHARGE CHAMBER CONCAVE PORTION

CROSS REFERENCE

This application is the U.S. National Phase under 35 U.S.C. § 371 of International Application No. PCT/JP2015/084844, filed on Dec. 11, 2015, which claims the benefit of Japanese Application No. 2015-235213, filed on Dec. 1, 2015, Japanese Application No. 2015-215273, filed on Oct. 30, 2015, and Japanese Application No. 2014-257818, filed on Dec. 19, 2014, the entire contents of each are hereby incorporated by reference.

TECHNICAL FIELD

The present invention relates to a two-cylinder type rotary compressor used in an air conditioner.

BACKGROUND ART

For example, in PTL 1, in a two-cylinder type rotary compressor, a technique is described in which heating of inlet refrigerant in inlet chamber sides of a lower cylinder and an upper cylinder by compressed refrigerant is suppressed, by a refrigerant path hole in which high-temperature compressed refrigerant compressed by the lower cylinder and discharged from a lower discharge hole flows from a lower end plate cover chamber (lower muffler chamber) to an upper end plate cover chamber (upper Muffler chamber) being disposed in a position away from the inlet chamber sides of the lower cylinder and the upper cylinder, and thus compressor efficiency is improved.

In addition, in PTL 2, a technique is described in which it is suppressed that high-temperature compressed refrigerant compressed by a lower cylinder and discharged from a lower discharge hole heats a lower end plate and inlet refrigerant in an inlet chamber of the lower cylinder is heated, and thus compressor efficiency is improved.

CITATION LIST

Patent Literature

PTL 1: JP-A-2014-145318
PTL 2: International Publication No. WO2013/094114

SUMMARY OF INVENTION

Technical Problem

In the rotary compressor described in PTL 1, since the lower endplate cover chamber formed between a lower endplate and a lower end plate cover has a large capacity by the lower end plate cover (lower muffler cover) being inflated, the amount of the refrigerant which is compressed by the upper cylinder, discharged from an upper discharge hole, reversely flows through the refrigerant path hole, and flows into the lower muffler chamber is large.

In the rotary compressor described in PTL 2, since a refrigerant path hole is disposed in a side opposite to a lower discharge valve accommodating portion with respect to the lower discharge hole provided in the lower end plate and the refrigerant discharged from the lower discharge hole flows through the lower discharge valve accommodating portion to the refrigerant path hole, it is necessary to make the lower discharge valve accommodating portion deep. Therefore, the capacity of a lower end plate cover chamber (refrigerant discharge space) is increased and thus the amount of the refrigerant which is compressed by an upper cylinder, discharged from an upper discharge hole, reversely flows through the refrigerant path hole, and flows into a lower muffler chamber is large.

Hereinafter, reverse flow phenomenon of the refrigerant described above will be described. In a two-cylinder type rotary compressor, in order to minimize the fluctuation of the torque per one rotation of a rotation shaft as much as possible, in general, the processes of inlet, compression, and discharge are made to be performed at 180° out of phase by two cylinders. In an operation of an air conditioner at normal outdoor temperature and indoor temperature excluding particular operating conditions such as at startup, a discharge process of one cylinder is about one-third of one rotation. Therefore, the one-third of one rotation is a discharge process of one cylinder (process in which discharge valve is open), the other one-third is a discharge process of the other cylinder, and the remaining one-third is a process in which both discharge valves are closed.

Here, when both discharge valves of the two cylinders are closed and the refrigerant discharged from a compression chamber does not flow, both the upper end plate cover chamber and the lower end plate cover chamber have the same pressure as that in a compressor housing outside the upper end plate cover chamber. In the discharge process of one cylinder, among the compressed high pressure regions, the pressure is the highest in the compression chamber which is the most upstream of flow of the refrigerant and then is lowered in the order of in the upper end plate cover chamber and in the compressor housing outside the upper end plate cover chamber. Therefore, immediately after the discharge valve of the upper cylinder is opened, the pressure in the upper end plate cover chamber becomes higher than the pressure in the compressor housing outside the upper end plate cover chamber or the lower end plate cover chamber. Therefore, at the next moment, the refrigerant reversely flows from the upper end plate cover chamber through in the compressor housing outside the upper end plate cover chamber and the refrigerant path hole and thus flow of the refrigerant to the lower muffler chamber is generated.

Although the flow of the refrigerant from the upper end plate cover chamber into the compressor housing outside the upper end plate cover chamber is the original flow, the refrigerant flowing from the upper end plate cover chamber to the lower end plate cover chamber flows again through the refrigerant path hole and the upper end plate cover chamber into the compressor housing outside the upper end plate cover chamber after completion of the discharge process of the upper cylinder, which is originally unnecessary flow and thus there is a problem that an energy is lost and efficiency of the rotary compressor is decreased.

In addition, in the rotary compressor described in PTL 2, heating of the lower end plate covering a lower surface of the lower cylinder is suppressed by the refrigerant compressed by the lower cylinder. However, in particular, in a state where the rotary compressor is stopped for a long time in an atmosphere that the outside air is low temperature, the liquefied refrigerant may be accumulated in an inside portion of the compressor housing. Since the density of the liquid refrigerant at a low temperature is larger than that of lubricant oil, the liquid refrigerant is accumulated at the lowermost portion in the inside portion of the compressor housing. When the rotary compressor is started in this state, the liquid refrigerant is sucked up from a lower end of a rotation shaft by an oil feeding impeller. When the liquid refrigerant is sucked up, since viscosity of the liquid refrigerant is lower than that of the lubricant oil, there is a risk that a sliding portion of a compressing unit becomes inferior in lubrication and is damaged.

Therefore, when the rotary compressor is started, although it is necessary to promptly heat and vaporize the liquid refrigerant, when heating of the lower end plate is suppressed as in the rotary compressor described in PTL 2, vaporization due to heating of the liquid refrigerant accumulated in the lower portion of the compressor housing is suppressed, and thus there is a problem that the liquid refrigerant is sucked up by the oil feeding impeller and causes damage due to inferior lubrication of the compressing unit.

In addition, in the rotary compressor, a portion of lubricant oil is entrained in the refrigerant in the inside portion of the compressor housing and discharged to the outside of the compressor housing, and the discharged lubricant oil circulates through a refrigerant circuit (refrigeration cycle) of the air conditioner and is sucked into the lower cylinder and the upper cylinder together with the inlet refrigerant. The lubricant oil sucked into the lower cylinder is discharged from the lower discharge hole to the lower end plate cover chamber together with the refrigerant. There is a problem that when the lubricant oil discharged into the lower end plate cover chamber is accumulated in the lower end plate cover chamber and the lower discharge hole is immersed in the lubricant oil, discharging resistance of the refrigerant is generated, and thus efficiency is decreased and noise is generated. This problem is more likely to occur as the capacity of the lower end plate cover chamber becomes further decreased.

An object of the invention is to suppress that the refrigerant compressed by the upper cylinder reversely flows through the refrigerant path hole to prevent the efficiency of the rotary compressor from being lowered.

Solution to Problem

According to an aspect of the invention, there is provided a rotary compressor, including a sealed vertically-placed cylindrical compressor housing in which a discharge pipe for discharging a refrigerant is provided in an upper portion thereof and an upper inlet pipe and a lower inlet pipe for sucking a refrigerant are provided in a side surface lower portion thereof; an accumulator which is fixed to a side portion of the compressor housing and is connected to the upper inlet pipe and the lower inlet pipe; a motor which is disposed in the compressor housing; and a compressing unit which is disposed in a lower side of the motor in the compressor housing, is driven by the motor to suck and compress a refrigerant from the accumulator via the upper inlet pipe and the lower inlet pipe, and discharge the compressed refrigerant from the discharge pipe, in which the compressing unit includes an annular upper cylinder and an annular lower cylinder, an upper end plate which closes an upper side of the upper cylinder and a lower end plate which closes a lower side of the lower cylinder, an intermediate partition plate which is disposed between the upper cylinder and the lower cylinder and closes a lower side of the upper cylinder and an upper side of the lower cylinder, a rotation shaft which is supported by a main bearing unit provided on the upper end plate and a sub-bearing unit provided on the lower end plate and which is rotated by the motor, an upper eccentric portion and a lower eccentric portion which are provided to the rotation shaft with a phase difference of 180° with respect to each other, an upper piston which is fitted in the upper eccentric portion and revolves along an inner circumferential surface of the upper cylinder to form an upper cylinder chamber in the upper cylinder, a lower piston which is fitted in the lower eccentric portion and revolves along an inner circumferential surface of the lower cylinder to form a lower cylinder chamber in the lower cylinder, an upper vane which protrudes from an upper vane groove provided in the upper cylinder into the upper cylinder chamber and abuts on the upper piston to divide the upper cylinder chamber into an upper inlet chamber and an upper compression chamber, a lower vane which protrudes from a lower vane groove provided in the lower cylinder into the lower cylinder chamber and abuts on the lower piston to divide the lower cylinder chamber into a lower inlet chamber and a lower compression chamber, an upper end plate cover which covers the upper end plate, forms an upper end plate cover chamber between the upper end plate and the upper end plate cover, and includes an upper end plate cover discharge hole for communicating the upper end plate cover chamber and the inside portion of the compressor housing with each other, a lower end plate cover which covers the lower end plate and forms a lower end plate cover chamber between the lower end plate and the lower end plate cover; an upper discharge hole which is provided in the upper end plate and communicates the upper compression chamber and the upper end plate cover chamber with each other, a lower discharge hole which is provided in the lower end plate and communicates the lower compression chamber and the lower end plate cover chamber with each other, and a refrigerant path hole which passes through the lower end plate, the lower cylinder, the intermediate partition plate, the upper end plate and the upper cylinder and communicates the lower end plate cover chamber and the upper end plate cover chamber with each other, and the rotary compressor, further including an upper discharge valve accommodation concave portion which is provided in the upper end plate and extends in a groove shape from a position of the upper discharge hole; a lower discharge valve accommodation concave portion which is provided in the lower end plate and extends in a groove shape from a position of the lower discharge hole; a reed valve type upper discharge valve of which a rear end portion is fixed by an upper rivet in the upper discharge valve accommodation concave portion and a front portion opens and closes the upper discharge hole and an upper discharge valve cap of which a rear end portion is overlapped with the upper discharge valve and is fixed in the upper discharge valve accommodation concave portion by the upper rivet, a front portion is warped to regulate opening degree of the upper discharge valve; a reed valve type lower discharge valve of which a rear end portion is fixed by a lower rivet in the lower discharge valve accommodation concave portion and a front portion opens and closes the lower discharge hole and a lower discharge valve cap of which a rear end portion is overlapped with the lower discharge valve and is fixed in the lower discharge valve accommodation concave portion by the lower rivet and a front portion is warped to regulate opening degree of the lower discharge valve, and is accommodated in the lower discharge valve accommodation concave portion; in which the lower endplate cover is formed in a flat plate shape, in which a lower discharge chamber concave portion is formed in the lower end plate so as to overlap the lower discharge hole side of the lower discharge valve accommodation concave portion, the lower discharge chamber concave portion is formed in a fan-like range between a diametrical line which passes through a center of the sub-bearing unit and a midpoint of a line segment which connects a center of the lower discharge hole and a center of the lower rivet to each other and a diametrical line which is opened by a pitch angle 90° in a direction of the lower discharge hole about a center of the sub-bearing unit, in which at least a portion of the refrigerant path hole overlaps with the lower discharge chamber concave portion and is disposed at a position communicating with the lower discharge chamber concave portion, and in which the lower end plate cover chamber is configured by the lower discharge chamber concave portion and the lower discharge valve accommodation concave portion.

Advantageous Effects of Invention

According to the invention, reverse flow of the refrigerant compressed by the lower cylinder through the refrigerant path hole is suppressed and thus decrease in efficiency of the rotary compressor can be prevented.

BRIEF DESCRIPTION OF DRAWINGS

FIG. 1 is a longitudinal sectional view illustrating Example 1 of a rotary compressor according to the invention.

FIG. 2 is an upward exploded perspective view illustrating a compressing unit of the rotary compressor of Example 1.

FIG. 3 is an upward exploded perspective view illustrating a rotation shaft and an oil feeding impeller of the rotary compressor of Example 1.

FIG. 4 is a bottom view illustrating a lower end plate of the rotary compressor of Example 1.

FIG. 5 is a longitudinal sectional view illustrating a lower discharge valve accommodation concave portion to which a lower discharge valve of the rotary compressor of Example 1 is attached.

FIG. 6 is a longitudinal sectional view illustrating a lower discharge valve accommodation concave portion to which a lower discharge valve of a rotary compressor of Example 2 is attached.

FIG. 7 is a longitudinal sectional view illustrating a lower discharge valve accommodation concave portion to which a lower discharge valve of a rotary compressor of Example 3 is attached.

FIG. 8 is a bottom view illustrating a lower end plate of a rotary compressor of Example 4.

FIG. 9 is a bottom view illustrating a lower end plate of a rotary compressor of Example 5.

FIG. 10 is a perspective view illustrating a lower end plate of a rotary compressor of Example 6 from below.

FIG. 11 is a bottom view illustrating a state where a lower endplate and a lower endplate cover of a rotary compressor of Example 7 are overlapped with each other.

DESCRIPTION OF EXAMPLES

Hereinafter, aspects (examples) for carrying out the invention will be described in detail with reference to the drawings.

EXAMPLE 1

FIG. 1 is a longitudinal sectional view illustrating a rotary compressor of Example 1 according to the invention, FIG. 2 is an upward exploded perspective view illustrating a compressing unit of the rotary compressor of Example 1, and FIG. 3 is an upward exploded perspective view illustrating a rotation shaft and an oil feeding impeller of the rotary compressor of Example 1 from above.

As illustrated in FIG. 1, a rotary compressor 1 includes a compressing unit 12 which is disposed in a lower portion in a sealed vertically-placed cylindrical compressor housing 10, a motor 11 which is disposed in the upper side of the compressing unit 12 and drives the compressing unit 12 via a rotation shaft 15, and a vertically-placed cylindrical accumulator 25 which is fixed to a side portion of the compressor housing 10.

The accumulator 25 is connected to an upper inlet chamber 131T (see FIG. 2) of an upper cylinder 121T via an upper inlet pipe 105 and an accumulator upper L-pipe 31T, and is connected to a lower inlet chamber 131S (see FIG. 2) of a lower cylinder 121S via a lower inlet pipe 104 and an accumulator lower L-pipe 31S.

The motor 11 includes a stator 111 on an outside thereof and a rotor 112 on an inside thereof, the stator 111 is shrink-fitting fixed to an inner circumferential surface of the compressor housing 10, and the rotor 112 is fixed to the rotation shaft 15 by shrink fitting.

The rotation shaft 15 is rotatably supported with respect to the entire compressing unit 12 and respectively revolves an upper piston 125T and a lower piston 125S by rotation along inner circumferential surfaces of the upper cylinder 121T and the lower cylinder 121S by a sub-shaft unit 151 below a lower eccentric portion 152S being rotatably fitted and supported to a sub-bearing unit 161S provided on a lower endplate 160S, a main shaft unit 153 of an upper side of an upper eccentric portion 152T being rotatably fitted and supported to a main bearing unit 161T provided on an upper end plate 160T, and the upper eccentric portion 152T and the lower eccentric portion 152S which are provided with 180 degrees of phase difference to each other being rotatably fitted to the upper piston 125T and the lower piston 125S, respectively.

In an inside portion of the compressor housing 10, lubricant oil 18 is enclosed by an amount substantially immersing the compressing unit 12 in order to lubricate a sliding portion of the compressing unit 12 and seal an upper compression chamber 133T (see FIG. 2) and a lower compression chamber 133S (see FIG. 2). An attachment leg 310 for locking a plurality of elastic supporting members (not illustrated) which supports the entire rotary compressor 1 is fixed to a lower side of the compressor housing 10.

As illustrated in FIG. 2, the compressing unit 12 is configured by, from above, an upper endplate cover 170T having a dome-shaped bulging portion, the upper end plate 160T, the upper cylinder 121T, an intermediate partition plate 140, the lower cylinder 121S, the lower end plate 160S and a lower end plate cover 170S having a flat plate shape being stacked. The entire compressing unit 12 is fixed by a plurality of penetrating bolts 174 and 175 and an auxiliary bolt 176 disposed in a substantially concentric circle from above and below.

An upper inlet hole 135T fitted to the upper inlet pipe 105 is provided in the annular upper cylinder 121T. A lower inlet hole 135S fitted to the lower inlet pipe 104 is provided in the annular lower cylinder 121S. In addition, the upper piston 125T is disposed in an upper cylinder chamber 130T of the upper cylinder 121T. The lower piston 125S is disposed in a lower cylinder chamber 130S of the lower cylinder 121S.

An upper vane groove 128T which extends from the upper cylinder chamber 130T to an outside in a radial direction is provided in the upper cylinder 121T and an upper vane 127T is disposed in the upper vane groove 128T. A lower vane groove 128S which extends from the lower cylinder chamber 130S to an outside in a radial direction is provided in the lower cylinder 121S and a lower vane 127S is disposed in the lower vane groove 128S.

In the upper cylinder 121T, an upper spring hole 124T having a depth which does not pass through the upper cylinder chamber 130T is provided at a position overlapping the upper vane groove 128T from the outside surface and an upper spring 126T is disposed in the upper spring hole 124T. In the lower cylinder 121S, a lower spring hole 124S having a depth which does not pass through the lower cylinder chamber 130S is provided at a position overlapping the lower vane groove 128S from the outside surface and a lower spring 126S is disposed in the lower spring hole 124S.

Upper and below of the upper cylinder chamber 130T are closed by the upper end plate 160T and the intermediate partition plate 140, respectively. Upper and below of the lower cylinder chamber 130S are closed by the lower end plate 160S and the intermediate partition plate 140, respectively.

The upper cylinder chamber 130T is divided into the upper inlet chamber 131T communicating with the upper inlet hole 135T and the upper compression chamber 133T communicating with an upper discharge hole 190T provided in the upper end plate 160T, by the upper vane 127T being pressed by the upper spring 126T and being abutted on an outer circumferential surface of the upper piston 125T. The lower cylinder chamber 130S is divided into the lower inlet chamber 131S communicating with the lower inlet hole 135S and the lower compression chamber 133S communicating with a lower discharge hole 190S provided in the lower end plate 160S, by the lower vane 127S being pressed by the lower spring 126S and being abutted on an outer circumferential surface of the lower piston 125S.

The upper end plate 160T includes the upper discharge hole 190T which passes through the upper end plate 160T and communicates with the upper compression chamber 133T of the upper cylinder 121T and an annular upper valve seat (not illustrated) surrounding the upper discharge hole 190T is formed on the outgoing hole side of the upper discharge hole 190T. An upper discharge valve accommodation concave portion 164T which extends in a groove shape from the position of the upper discharge hole 190T in the circumferential direction of the upper endplate 160T is formed on the upper endplate 160T.

A reed valve type upper discharge valve 200T of which a rear end portion is fixed in the upper discharge valve accommodation concave portion 164T by an upper rivet 202T and a front portion opens and closes the upper discharge hole 190T and the entire of an upper discharge valve cap 201T of which a rear end portion is overlapped with the upper discharge valve 200T and is fixed in the upper discharge valve accommodation concave portion 164T by the upper rivet 202T and a front portion is curved (warped) to regulate opening degree of the upper discharge valve 200T are accommodated in the upper discharge valve accommodation concave portion 164T.

The lower end plate 160S includes the lower discharge hole 190S which passes through the lower end plate 160S and communicates with the lower compression chamber 133S of the lower cylinder 121S, and an annular lower valve seat 191S (see FIG. 4) surrounding the lower discharge hole 190S is formed on an outgoing hole side of the lower discharge hole 190S. A lower discharge valve accommodation concave portion 164S (see FIG. 4) which extends in a groove shape from the position of the lower discharge hole 190T in the circumferential direction of the lower end plate 160S is formed on the lower end plate 160S.

A reed valve type lower discharge valve 200S of which a rear end portion is fixed in the lower discharge valve accommodation concave portion 164S by a lower rivet 202S and a front portion opens and closes the lower discharge hole 190S and the entire of a lower discharge valve cap 201S of which a rear end portion is overlapped with the lower discharge valve 200S and is fixed in the lower discharge valve accommodation concave portion 164S by the lower rivet 202S and a front portion is curved (warped) to regulate opening degree of the lower discharge valve 200S are accommodated in the lower discharge valve accommodation concave portion 164S.

An upper end plate cover chamber 180T is formed between the upper end plate 160T and the upper end plate cover 170T having the dome-shaped bulging portion, which are tightly fixed to each other. A lower end plate cover chamber 180S is formed between the lower end plate 160S and the lower endplate cover 170S having a flat plate shape, which are tightly fixed to each other (details of lower end plate cover chamber 180S will be described below). A refrigerant path hole 136 which passes through the lower end plate 160S, the lower cylinder 121S, the intermediate partition plate 140, the upper end plate 160T, and the upper cylinder 121T and communicates the lower end plate cover chamber 180S and the upper end plate cover chamber 180T with each other is provided.

As illustrated in FIG. 3, the rotation shaft 15 includes an oil feeding vertical hole 155 which passes through from a lower end thereof to an upper end thereof, and an oil feeding impeller 158 is press-fitted into the oil feeding vertical hole 155. In addition, a plurality of oil feeding horizontal holes 156 which communicate with the oil feeding vertical hole 155 are provided on a side surface of the rotation shaft 15.

Hereinafter, the flow of the refrigerant due to the rotation of the rotation shaft 15 will be described. In the upper cylinder chamber 130T, the upper inlet chamber 131T sucks refrigerant from the upper inlet pipe 105 while expanding the capacity thereof and the upper compression chamber 133T compresses the refrigerant while reducing capacity thereof by the upper piston 125T fitted to the upper eccentric portion 152T of the rotation shaft 15 being revolved along the outer circumferential surface (inner circumferential surface of upper cylinder 121T) of the upper cylinder chamber 130T by rotation of the rotation shaft 15, and when the pressure of the compressed refrigerant is higher than the pressure of the upper end plate cover chamber 180T outside the upper discharge valve 200T, the upper discharge valve 200T opens and the refrigerant is discharged from the upper compression chamber 133T to the upper end plate cover chamber 180T. The refrigerant discharged into the upper end plate cover chamber 180T is discharged from an upper end plate cover discharge hole 172T (see FIG. 1) provided in the upper end plate cover 170T into the compressor housing 10.

In addition, in the lower cylinder chamber 130S, the lower inlet chamber 131S sucks refrigerant from the lower inlet pipe 104 while expanding the capacity thereof and the lower compression chamber 133S compresses the refrigerant while reducing capacity thereof by the lower piston 125S fitted to the lower eccentric portion 152S of the rotation shaft 15 being revolved along the outer circumferential surface (inner circumferential surface of lower cylinder 121S) of the lower cylinder chamber 130S by rotation of the rotation shaft 15, and when the pressure of the compressed refrigerant is higher than the pressure of the lower end plate cover chamber 180S outside the lower discharge valve 200S, the lower discharge valve 200S opens and the refrigerant is discharged from lower compression chamber 133S to the lower end plate cover chamber 180S. The refrigerant discharged into the lower end plate cover chamber 180S is discharged from the upper endplate cover discharge hole 172T (see FIG. 1) provided in the upper end plate cover 170T into the compressor housing 10 through the refrigerant path hole 136 and the upper endplate cover chamber 180T.

The refrigerant discharged into the compressor housing 10 is introduced into upper of the motor 11 through a cutout (not illustrated) provided on the outer circumference of the stator 111 and communicating up and down, a gap (not illustrated) between winding portions of the stator 111, or a gap 115 (see FIG. 1) between the stator 111 and the rotor 112 and is discharged from a discharge pipe 107 of the upper portion of the compressor housing 10.

Hereinafter, the flow of the lubricant oil 18 will be described below. The lubricant oil 18 passes through the oil feeding vertical hole 155 and the plurality of oil feeding horizontal holes 156 from the lower end of the rotation shaft 15 and is supplied to a sliding surface between the sub-bearing unit 161S and the sub-shaft unit 151 of the rotation shaft 15, a sliding surface between the main bearing unit 161T and the main shaft unit 153 of the rotation shaft 15, a sliding surface between the lower eccentric portion 152S of the rotation shaft 15 and the lower piston 125S, and a sliding surface between the upper eccentric portion 152T and the upper piston 125T and thus lubricates respective sliding surfaces.

The oil feeding impeller 158 sucks up the lubricant oil 18 by applying a centrifugal force to the lubricant oil 18 in the oil feeding vertical hole 155 and in a case where the lubricant oil 18 is discharged together with the refrigerant from the inside of the compressor housing 10 and thus the oil level is lowered, the oil feeding impeller plays a role of reliably supplying the lubricant oil 18 to the sliding surfaces.

Next, the characteristic configuration of the rotary compressor 1 of Example 1 will be described. FIG. 4 is a bottom view illustrating the lower end plate of the rotary compressor of Example 1 and FIG. 5 is a longitudinal sectional view illustrating the lower discharge valve accommodation concave portion to which the lower discharge valve of the rotary compressor of Example 1 is attached.

As illustrated in FIG. 4, since the lower endplate cover 170S has a flat plate shape and does not have the dome-shaped bulging portion like the upper endplate cover 170T, the lower endplate cover chamber 180S is configured by a lower discharge chamber concave portion 163S and the lower discharge valve accommodation concave portion 164S which are provided in the lower endplate 160S. The lower discharge valve accommodation concave portion 164S extends linearly in a groove shape from the position of the lower discharge hole 190S in a direction intersecting with a diametrical line $L_1$ connecting a center $O_1$ of the sub-bearing unit 161S and a center $O_2$ of the lower discharge hole 190S, in other words, in the circumferential direction of the lower end plate 160S. The lower discharge valve accommodation concave portion 164S is connected to the lower discharge chamber concave portion 163S. The width of the lower discharge valve accommodation concave portion 164S is formed to be slightly larger than those of the lower discharge valve 200S and the lower discharge valve cap 201S, and thus the lower discharge valve accommodation concave portion 164S accommodates the lower discharge valve 200S and the lower discharge valve cap 201S and positions the lower discharge valve 200S and the lower discharge valve cap 201S.

The lower discharge chamber concave portion 163S is formed to have the same depth as the lower discharge valve accommodation concave portion 164S so as to overlap the lower discharge hole 190S side of the lower discharge valve accommodation concave portion 164S. The lower discharge hole 190S side of the lower discharge valve accommodation concave portion 164S is accommodated in the lower discharge chamber concave portion 163S.

The lower discharge chamber concave portion 163S is formed in a fan-like range between a diametrical line $L_3$ passing through the center $O_1$ of the sub-bearing unit 161S and a midpoint $O_4$ of a line segment $L_2$ (length F) connecting the center $O_2$ of the lower discharge hole 190S and a center $O_3$ of the lower rivet 202S to each other and a diametrical line $L_4$ which is opened by a pitch angle of 90° in the direction of the lower discharge hole 190S about the center $O_1$ of the sub-bearing unit 161S. At least a portion of the refrigerant path hole 136 overlaps the lower discharge chamber concave portion 163S and the refrigerant path hole 136 is disposed at a position which communicates with the lower discharge chamber concave portion 163S.

As illustrated in FIG. 5, the annular lower valve seat 191S protruding with respect to a bottom portion of the lower discharge chamber concave portion 163S is formed on the circumferential edge of an opening portion of the lower discharge hole 190S and the lower valve seat 191S abuts on a front portion of the lower discharge valve 200S. The depth H to the lower valve seat 191S of the lower discharge chamber concave portion 163S is set to 1.5 times or less the diameter ϕD1 of the lower discharge hole 190S.

The opening degree of the lower discharge valve 200S, that is, a lift amount of the lower discharge valve 200S with respect to the lower valve seat 191S when the refrigerant is discharged from the lower discharge hole 190S is required to be a lift amount that does not generate resistance of the discharge flow. Therefore, the depth H to the lower valve seat 160S of the lower discharge chamber concave portion 163S needs to be determined in consideration of the lift amount of the lower discharge valve 200S and the thicknesses of the lower discharge valve 200S and the lower discharge valve cap 201S and it is sufficient that the depth H is 1.5 times the diameter ϕD1 of the lower discharge hole 190S.

At least a portion of the refrigerant path hole 136 overlaps an upper discharge chamber concave portion 163T and the refrigerant path hole 136 is disposed at a position communicating with the upper discharge chamber concave portion 163T. Although not illustrated in detail, the upper discharge chamber concave portion 163T and the upper discharge valve accommodation concave portion 164T formed in the upper end plate 160T are formed in the same shape as the lower discharge chamber concave portion 163S and the lower discharge valve accommodation concave portion 164S formed in the lower end plate 160S. The upper end plate cover chamber 180T is configured by the dome-shaped bulging portion of the upper end plate cover 170T, the upper discharge chamber concave portion 163T and the upper discharge valve accommodation concave portion 164T.

According to the configuration of the rotary compressor 1 of Example 1 described above, the distance between the lower discharge hole 190S and an incoming hole of the refrigerant path hole 136 can be shortened. Therefore, the capacity of the lower end plate cover chamber 180S, that is, the capacity of the sum of the capacity of the lower discharge chamber concave portion 163S and the capacity of the lower discharge valve accommodation concave portion 164S can be significantly reduced as compared with the related art.

Accordingly, the flow rate of the refrigerant compressed by the upper cylinder 121T and discharged from the upper discharge hole 190T which reversely flows through the refrigerant path hole 136 and flows into the lower end plate cover chamber 180S can be decreased and thus decrease in the efficiency of the rotary compressor 1 can be prevented.

EXAMPLE 2

FIG. 6 is a longitudinal sectional view illustrating a lower discharge valve accommodation concave portion to which a lower discharge valve of a rotary compressor of Example 2 is attached. As illustrated in FIG. 6, in the rotary compressor 1 of Example 2, the depth H2 to a lower discharge chamber concave portion 163S2 formed in a lower endplate 160S2 and the lower valve seat 191S of a lower discharge valve accommodation concave portion 164S2 is made shallower than the depth H to the lower discharge chamber concave portion 163S formed in the lower end plate 160S of the rotary compressor 1 of Example 1 and the lower valve seat 191S of the lower discharge valve accommodation concave portion 164S. A lower end plate cover 170S2 includes a concave portion 171S2 in a portion facing the front portion of the lower discharge valve cap 201S and accommodates a portion where the front portion of the lower discharge valve cap 201S protrudes from the lower discharge chamber concave portion 163S2. The depth from the concave portion 171S2 to the lower valve seat 191S is formed to be 1.5 times or less the diameter ϕD1 of the lower discharge hole 190S.

According to the configuration of the rotary compressor 1 of Example 2 described above, the capacity of the lower discharge valve accommodation concave portion 164S2 can be further decreased than that of the rotary compressor 1 of Example 1, and thus the flow rate of the refrigerant compressed by the upper cylinder 121T and discharged from the upper discharge hole 190T which reversely flows through the refrigerant path hole 136 and flows into a lower end plate cover chamber 180S2 can be further decreased and thus decrease in the efficiency of the rotary compressor 1 can be prevented.

EXAMPLE 3

FIG. 7 is a longitudinal sectional view illustrating a lower discharge valve accommodation concave portion to which a lower discharge valve of a rotary compressor of Example 3 is attached. As illustrated in FIG. 7, in the rotary compressor 1 of Example 3, a front end portion of a lower discharge valve cap 201S3 is formed such that the thickness of a portion close to the lower end plate cover 170S is further decreased than that of the other portion thereof. Accordingly, while securing the same opening degree as that of the lower discharge valve 201S of the rotary compressor 1 of Example 1, the depth H2 to a lower discharge chamber concave portion 163S3 and the lower valve seat 191S of a lower discharge valve accommodation concave portion 164S3 is made shallower as in Example 2.

According to the configuration of the rotary compressor 1 of Example 3 described above, the capacity of a lower end plate cover chamber 180S3 can be further decreased by the capacity of the concave portion 171S2 of Example 2 than the rotary compressor 1 of Example 2, and thus the flow rate of the refrigerant compressed by the upper cylinder 121T and discharged from the upper discharge hole 190T which reversely flows through the refrigerant path hole 136 and flows into the lower end plate cover chamber 180S3 can be further decreased and thus decrease in the efficiency of the rotary compressor 1 can be prevented.

EXAMPLE 4

FIG. 8 is a bottom view illustrating a lower end plate of a rotary compressor of Example 4. As illustrated in FIG. 4, in the rotary compressor 1 of Example 4, two refrigerant path holes 136N are provided (three or more refrigerant path holes may be provided) in a lower end plate 160S4 (and lower cylinder 121S, intermediate partition plate 140, upper cylinder 121T, upper end plate 160T), which are further decreased in diameter than the refrigerant path hole 136 of the rotary compressor 1 of Example 1. The total sectional area of the two (or three or more) refrigerant path holes 136N is set to be equal to the sectional area of the refrigerant path hole 136 of the rotary compressor 1 of Example 1. Accordingly, the radius R1 from the center $O_1$ of the sub-bearing unit 161S to the outermost circumference of the refrigerant path hole 136N can be set to be further decreased than the radius R1 from the center $O_1$ of the sub-bearing unit 161S to the outermost circumference of the refrigerant path hole 136 of the rotary compressor 1 in Example 1 illustrated in FIG. 4 and the diameter of a circular lower discharge chamber concave portion 163S4 can be decreased.

According to the configuration of the rotary compressor 1 of Example 4 described above, the bottom area of the lower discharge chamber concave portion 163S4 can be further decreased than the bottom area of the lower discharge chamber concave portion 163S of the rotary compressor 1 of Example 1 and the capacity of the lower discharge chamber concave portion 163S4 can be decreased, and thus the flow rate of the refrigerant compressed by the upper cylinder 121T and discharged from the upper discharge hole 190T which reversely flows through the refrigerant path hole 136N and flows into a lower end plate cover chamber 180S4 can be further decreased and thus decrease in the efficiency of the rotary compressor 1 can be prevented.

In addition, since the radius R1 from the center $O_1$ of the sub-bearing unit 161S to the outermost circumference of the refrigerant path hole 136N can be set to be further decreased than the radius R1 from the center $O_1$ of the sub-bearing unit 161S to the outermost circumference of the refrigerant path hole 136 of the rotary compressor 1 in Example 1 illustrated in FIG. 4, the radius R2 of the lower end plate 160S4 (and lower cylinder 121S, intermediate partition plate 140, upper cylinder 121T, and upper end plate 160T) can be further decreased than the radius R2 (See FIG. 4) of the lower end plate 160S (and lower cylinder 121S, intermediate partition plate 140, upper cylinder 121T, and upper end plate 160T) of Example 1, and thus there is also an effect of reducing material cost of the compressing unit 12.

EXAMPLE 5

FIG. 9 is a bottom view illustrating a lower end plate of a rotary compressor of Example 5. As illustrated in FIG. 9, in the rotary compressor 1 of Example 5, a refrigerant path hole 136M provided in a lower end plate 160S5 (and lower cylinder 121S, intermediate partition plate 140, upper cylinder 121T, and upper end plate 160T) is a long hole whose width is further decreased than the diameter of the refrigerant path hole 136N of the rotary compressor 1 of Example 4, and the sectional areas thereof are equal to each other. The refrigerant path hole (long hole) 136M is formed along the circumferential direction of the lower valve seat 191S. Accordingly, the radius R1 from the center $O_1$ of the sub-bearing unit 161S to the outermost circumference of the refrigerant path hole 136M can be set to be further decreased than the radius R1 from the center $O_1$ of the sub-bearing unit 161S to the outermost circumference of the refrigerant path hole 136N of the rotary compressor 1 in Example 4 illustrated in FIG. 8, and the diameter of a circular lower discharge chamber concave portion 163S5 can be reduced.

According to the configuration of the rotary compressor 1 of Example 5 described above, the bottom area of the lower discharge chamber concave portion 163S5 is further decreased than the bottom area of the lower discharge chamber concave portion 163S4 of the rotary compressor 1 of Example 4 and the capacity of the lower discharge chamber concave portion 163S5 can be decreased, and thus the flow rate of the refrigerant compressed by the upper cylinder 121T and discharged from the upper discharge hole 190T which reversely flows through the refrigerant path hole 136M and flows into a lower end plate cover chamber 180S5 can be further decreased and thus decrease in the efficiency of the rotary compressor 1 can be prevented.

In addition, since the radius R1 from the center $O_1$ of the sub-bearing unit 161S to the outermost circumference of the refrigerant path hole 136M can be set to be further decreased than the radius R1 from the center $O_1$ of the sub-bearing unit 161S to the outermost circumference of the refrigerant path hole 136N of the rotary compressor 1 in Example 4 illustrated in FIG. 8, the radius R2 of the lower end plate 160S5 (and lower cylinder 121S, intermediate partition plate 140, upper cylinder 121T, and upper end plate 160T) can be further decreased than the radius R2 (See FIG. 4) of the lower end plate 160S4 (and lower cylinder 121S, intermediate partition plate 140, upper cylinder 121T, and upper end plate 160T) of Example 4, and thus there is also an effect of reducing material cost of the compressing unit 12.

EXAMPLE 6

FIG. 10 is a perspective view illustrating a lower end plate of a rotary compressor of Example 6 from below. As illustrated in FIG. 10, in the rotary compressor 1 of Example 6, in a region other than the region on which the lower discharge chamber concave portion 163S and the lower discharge valve accommodation concave portion 164S of a lower surface (which is contact surface with lower end plate cover 170S of Example 1) of a lower end plate 160S6 are formed, a refrigerant introduction portion 165S6 which is an annular groove surrounding the sub-bearing unit 161S and having a depth of 1 mm or less is formed in an inside of a plurality of bolt holes 137. The annular groove serving as the refrigerant introduction portion 165S6 may be formed on the upper surface of the lower end plate cover 170S instead of the lower surface of the lower end plate 160S6.

One end of the refrigerant introduction portion 165S6 communicates with the lower discharge chamber concave portion 163S and the other end thereof communicates with the lower discharge valve accommodation concave portion 164S (refrigerant introduction portion 165S6 may communicate with any one of lower discharge chamber concave portion 163S and lower discharge valve accommodation concave portion 164S). The high temperature and high pressure refrigerant discharged from the lower discharge hole 190S is guided to the refrigerant introduction portion 165S6 through the lower discharge chamber concave portion 163S or the lower discharge valve accommodation concave portion 164S by the refrigerant introduction portion 165S6 communicating with the lower discharge chamber concave portion 163S or the lower discharge valve accommodation concave portion 164S.

When the lower end plate cover 170S is heated by the high-temperature and high-pressure refrigerant being guided to the refrigerant introduction portion 165S6 and the air conditioner is started in a state of being stopped for a long time, liquid refrigerant 19 (see FIG. 1) staying in the lower portion of the compressor housing 10 of the rotary compressor 1 is heated, is evaporated as quickly as possible, and sucks up the liquid refrigerant 19 instead of the lubricant oil 18 for a long time and thus damage of the sliding portion of the compressing unit 12 can be prevented. In order to reduce the amount of the refrigerant compressed by the upper cylinder 121T reversely flowing through the refrigerant path hole 136, the capacity of the space of the refrigerant introduction portion 165S6 is preferably decreased within a range that can secure the heating amount necessary for vaporizing the liquid refrigerant 19 and thus the depth of the refrigerant introduction portion 165S6 is made shallow within a range that can secure a heating amount necessary for vaporizing the liquid refrigerant 19.

EXAMPLE 7

FIG. 11 is a bottom view illustrating a state where a lower end plate and a lower end plate cover of a rotary compressor according to Example 7 are stacked. As illustrated in FIG. 11, in the rotary compressor 1 of Example 7, two auxiliary bolt relief holes 171S7 are provided in a lower end plate cover 170S7 having a flat plate shape so that a head of the auxiliary bolt 176 (see FIG. 3) for fastening the lower end plate 160S6 and the lower cylinder 121S of Example 6 is prevented from hitting the lower end plate cover 170S7. A portion of the auxiliary bolt relief hole 171S7 overlaps and communicates with the refrigerant introduction portion 165S6 formed in the lower endplate 160S6 to constitute a refrigerant discharge portion 172S7. In a case where the auxiliary bolt relief hole 171S7 does not overlap with the refrigerant introduction portion 165S6, a small hole (not illustrated) which communicates with the lower discharge chamber concave portion 163S, the lower discharge valve accommodation concave portion 164S, or the refrigerant introduction portion 165S6 is separately provided in the lower end plate cover 170S7 (170S, 170S2) and this small hole may be used as the refrigerant discharge portion 172S7.

The refrigerant discharge portion 172S7 directly discharges the compressed refrigerant into the compressor housing 10 without passing through the refrigerant path hole 136. The lubricant oil 18 is accumulated in the lower discharge chamber concave portion 163S and the lower discharge valve accommodation concave portion 164S of the lower endplate 160S6, the lower discharge hole 190S is immersed by the lubricant oil 18, and thus the decrease in efficiency and the generation of noise can be prevented, by the refrigerant discharge portion 172S7. In addition, by providing the refrigerant discharge portion 172S7, the refrigerant discharged from the refrigerant discharge portion 172S7 heats the liquid refrigerant 19 (see FIG. 1) staying in the lower portion of the compressor housing 10 in a state of stopping for a long time, and thus there is an effect of vaporization of refrigerant being promoted.

As described above, although the examples are described, the examples are not limited by the contents described above. In addition, configuration elements described above include those easily assumed by those skilled in the art, substantially the same ones, and so-called equivalents. Further, the configuration elements described above can be appropriately combined with each other. Further, at least one of various omission, substitution, and change of the configuration elements can be performed without departing from the gist of the example.

REFERENCE SIGNS LIST

1: rotary compressor
10: compressor housing
11: motor
12: compressing unit
15: rotation shaft
18: lubricant oil
19: liquid refrigerant
25: accumulator
31T: accumulator upper L-pipe
31S: accumulator lower L-pipe
105: upper inlet pipe
104: lower inlet pipe
107: discharge pipe
111: stator
112: rotor
115: gap
121T: upper cylinder
121S: lower cylinder
124T: upper spring hole
124S: lower spring hole
125T: upper piston
125S: lower piston
126T: upper spring
126S: lower spring
127T: upper vane
127S: lower vane
128T: upper vane groove
128S: lower vane groove
130T: upper cylinder chamber
130S: lower cylinder chamber
131T: upper inlet chamber
131S: lower inlet chamber
133T: upper compression chamber
133S: lower compression chamber
135T: upper inlet hole
135S: lower inlet hole
136, 136N, 136M: refrigerant path hole
137: bolt hole
140: intermediate partition plate
151: sub-shaft unit
152T: upper eccentric portion
152S: lower eccentric portion
153: main shaft unit
155: oil feeding vertical hole
156: oil feeding horizontal hole
158: oil feeding impeller
160T: upper end plate
160S, 160S2, 160S4, 160S5, 160S6: lower end plate
161T: main bearing unit
161S: sub-bearing unit
163T: upper discharge chamber concave portion
163S, 163S2, 163S3, 163S4, 163S5: lower discharge chamber concave portion
164T: upper discharge valve accommodation concave portion
164S, 164S2, 164S3: lower discharge valve accommodation concave portion
165S6: refrigerant introduction portion
166S8: refrigerant discharge portion
170T: upper end plate cover
170S, 170S2, 170S7: lower end plate cover
171S2: concave portion
171S7: auxiliary bolt relief hole
172S7: refrigerant discharge portion
172T: upper end plate cover discharge hole
174, 175: penetrating bolt
176: auxiliary bolt
180T: upper end plate cover chamber
180S, 180S2, 180S3, 180S4, 180S5: lower endplate cover chamber
190T: upper discharge hole
190S: lower discharge hole
191S: lower valve seat
200T: upper discharge valve
200S: lower discharge valve
201T: upper discharge valve cap
201S, 201S3: lower discharge valve cap
202T: upper rivet
202S: lower rivet
310: attachment leg

The invention claimed is:

1. A rotary compressor, comprising:

a sealed vertically-placed cylindrical compressor housing in which a discharge pipe for discharging refrigerant is provided in an upper portion thereof and an upper inlet pipe and a lower inlet pipe for sucking refrigerant are provided in a side surface lower portion thereof; an accumulator which is fixed to a side portion of the compressor housing and is connected to the upper inlet pipe and the lower inlet pipe; a motor which is disposed in the compressor housing; and a compressing unit which is disposed in a lower side of the motor in the compressor housing, is driven by the motor to suck and compress refrigerant from the accumulator via the upper inlet pipe and the lower inlet pipe, and discharges the compressed refrigerant from the discharge pipe, wherein the compressing unit includes an annular upper cylinder and an annular lower cylinder, an upper end plate which closes an upper side of the upper cylinder and a lower end plate which closes a lower side of the lower cylinder, a intermediate partition plate which is disposed between the upper cylinder and the lower cylinder and closes a lower side of the upper cylinder and an upper side of the lower cylinder, a rotation shaft which is supported by a main bearing unit provided on the upper end plate and a sub-bearing unit provided on the lower end plate and which is rotated by the motor, an upper eccentric portion and a lower eccentric portion which are provided to the rotation shaft with a phase difference of 180° with respect to each other, an upper piston which is fitted in the upper eccentric portion and revolves along an inner circumferential surface of the upper cylinder to form an upper cylinder chamber in the upper cylinder, a lower piston which is fitted in the lower eccentric portion and revolves along an inner circumferential surface of the lower cylinder to form a lower cylinder chamber in the lower cylinder, an upper vane which protrudes from an upper vane groove provided in the upper cylinder into the upper cylinder chamber and abuts on the upper piston to divide the upper cylinder chamber into an upper inlet chamber and an upper compression chamber, a lower vane which protrudes from a lower vane groove provided in the lower cylinder into the lower cylinder chamber and abuts on the lower piston to divide the lower cylinder chamber into a lower inlet chamber and a lower compression chamber, an upper end plate cover which covers the upper end plate, forms an upper end plate cover chamber between the upper end plate and the upper end plate cover, and includes an upper end plate cover discharge hole for communicating the upper end plate cover chamber and an inside portion of the compressor housing with each other, a lower end plate cover which covers the lower end plate and forms a lower end plate cover chamber between the lower end plate and the lower end plate cover, an upper discharge hole which is provided in the upper end plate and communicates the upper compression chamber and the upper end plate cover chamber with each other, a lower discharge hole which is provided in the lower end plate and communicates the lower compression chamber and the lower end plate cover chamber with each other, and a refrigerant path hole which passes through the lower end plate, the lower cylinder, the intermediate partition plate, the upper end plate and the upper cylinder and communicates the lower end plate cover chamber and the upper end plate cover chamber with each other, and the rotary compressor, further comprising:

an upper discharge valve accommodation concave portion which is provided in the upper end plate and extends in a groove shape from a position of the upper discharge hole;

a lower discharge valve accommodation concave portion which is provided in the lower end plate and extends in a groove shape from a position of the lower discharge hole;

a reed valve type upper discharge valve of which a rear end portion is fixed by an upper rivet in the upper discharge valve accommodation concave portion and a front portion opens and closes the upper discharge hole and an upper discharge valve cap of which a rear end portion is overlapped with the upper discharge valve and is fixed in the upper discharge valve accommodation concave portion by the upper rivet and a front portion is warped to regulate opening degree of the upper discharge valve; and a reed valve type lower discharge valve of which a rear end portion is fixed by a lower rivet in the lower discharge valve accommodation concave portion and a front portion opens and closes the lower discharge hole and a lower discharge valve cap of which a rear end portion is overlapped with the lower discharge valve and is fixed in the lower discharge valve accommodation concave portion by the lower rivet, a front portion is warped to regulate opening degree of the lower discharge valve, and is accommodated in the lower discharge valve accommodation concave portion, wherein the lower end plate cover is formed in a flat plate shape, wherein a lower discharge chamber concave portion is formed in the lower end plate so as to overlap the lower discharge hole side of the lower discharge valve accommodation concave portion, and the lower discharge chamber concave portion is formed in a fan-like range between a diametrical line which passes through a center of the sub-bearing unit and a midpoint of a line segment which connects a center of the lower discharge hole and a center of the lower rivet to each other and a diametrical line which is opened by a pitch angle 90° in a direction of the lower discharge hole about a center of the sub-bearing unit, wherein at least a portion of the refrigerant path hole overlaps with the lower discharge chamber concave portion and is disposed at a position communicating with the lower discharge chamber concave portion, and wherein the lower end plate cover chamber is configured by the lower discharge chamber concave portion and the lower discharge valve accommodation concave portion.

2. The rotary compressor according to claim 1, wherein a lower valve seat raised in an annular shape is included at a circumferential edge of the lower discharge hole and a depth of the lower discharge chamber concave portion from a bottom end of the lower discharge chamber concave portion to a bottom end of the lower valve seat is formed to be 1.5 times or less of a diameter ϕD1 of the lower discharge hole.

3. The rotary compressor according to claim 1, wherein a lower valve seat raised in an annular shape is included at a circumferential edge of the lower discharge hole, the lower end plate cover includes a concave portion in a portion facing a front end portion of the lower discharge valve cap, and a depth from the concave portion to the lower valve seat is formed to be 1.5 times or less of a diameter ϕD1 of the lower discharge hole.

4. The rotary compressor according to claim 1, wherein a front end portion of the lower discharge valve cap is formed so that a thickness of a portion close to the lower end plate cover is thinner than that of the other portion thereof.

5. The rotary compressor according to claim 1, wherein the refrigerant path hole is configured by a plurality of circular holes.

6. The rotary compressor according to claim 1, wherein the refrigerant path hole is a long hole along a circumferential direction of a lower valve seat of the lower discharge hole.

7. The rotary compressor according to claim 1, wherein a refrigerant introduction portion which communicates with the lower discharge chamber concave portion or the lower discharge valve accommodation concave portion is formed in the lower end plate or the lower end plate cover as a groove having an annular depth of 1 mm or less surrounding the sub-bearing unit of the lower end plate.

8. The rotary compressor according to claim 1, wherein a refrigerant discharge portion, which discharges the refrigerant into the compressor housing, is provided in the lower end plate cover, and the refrigerant discharge portion directly connects an inside of the compressor housing and the lower discharge chamber concave portion, the lower discharge valve accommodation concave portion, or the refrigerant introduction portion.

* * * * *